US008402606B1

(12) United States Patent
Tsai

(10) Patent No.: US 8,402,606 B1
(45) Date of Patent: Mar. 26, 2013

(54) DOOR CLOSER WITH BUFFER MECHANISM FOR A SLIDING DOOR

(76) Inventor: Patrick Tsai, Taipei (TW)

( * ) Notice: Subject to any disclaimer, the term of this patent is extended or adjusted under 35 U.S.C. 154(b) by 37 days.

(21) Appl. No.: 13/275,432

(22) Filed: Oct. 18, 2011

(51) Int. Cl.
*E05F 3/00* (2006.01)
*E05F 1/00* (2006.01)

(52) U.S. Cl. ..... 16/49; 16/71; 16/82

(58) Field of Classification Search ..... 16/49, 71, 16/86 B, 70, 72, 80, 85, DIG. 10, 91, 94 R, 16/102, 106, 107; 49/404, 407, 386, 451, 49/454, 455, 409; 312/322, 332.1, 333, 334.44, 312/334.46, 319.1; 292/262, 266–270, 277, 292/173, 38, DIG. 46; 160/199, 196.1, 206
See application file for complete search history.

(56) References Cited

U.S. PATENT DOCUMENTS

| | | | | |
|---|---|---|---|---|
| 4,004,372 | A * | 1/1977 | Beard et al. | 49/404 |
| 4,317,254 | A * | 3/1982 | Chaddock | 16/61 |
| 4,506,407 | A * | 3/1985 | Downey | 16/48.5 |
| 4,858,272 | A * | 8/1989 | Ogawa et al. | 16/80 |
| 5,906,026 | A * | 5/1999 | Junttila | 16/85 |
| 6,052,867 | A * | 4/2000 | Haab et al. | 16/87.6 R |
| 6,253,417 | B1 * | 7/2001 | Rusiana | 16/82 |
| 6,336,246 | B1 * | 1/2002 | Giovannetti | 16/87 R |
| 6,438,795 | B1 * | 8/2002 | Haab et al. | 16/85 |
| 6,516,575 | B2 * | 2/2003 | Haab et al. | 52/243.1 |
| 7,430,832 | B2 * | 10/2008 | Hung | 49/404 |
| 8,307,497 | B2 * | 11/2012 | Chang et al. | 16/71 |
| 2011/0023370 | A1 * | 2/2011 | Zimmer et al. | 49/360 |

FOREIGN PATENT DOCUMENTS

| | | | |
|---|---|---|---|
| JP | 2004068458 | A * | 3/2004 |
| JP | 2011074737 | A * | 4/2011 |
| WO | WO 2006011294 | A1 * | 2/2006 |

* cited by examiner

*Primary Examiner* — Chuck Y. Mah
(74) *Attorney, Agent, or Firm* — Birch, Stewart, Kolasch & Birch, LLP

(57) ABSTRACT

A door closer for a top hung sliding door has a buffer mechanism and a trolley hanger. The buffer mechanism includes a stationary base, a sliding block, a hook, two buffers and two resilient members. The sliding block is slidably mounted on the stationary base. The hook is pivotally mounted on the sliding block. The buffers are mounted on the stationary base and each buffer has a piston rod secured to the sliding block. The resilient members are mounted on the stationary base and each resilient member has one end secured to the sliding block. The trolley hanger has at least one engaging recess selectively engaging the hook. Therefore, the buffers can provide a buffering force and the resilient members can release a resilient force to reduce a moving speed of a door panel.

20 Claims, 8 Drawing Sheets

DOOR CLOSER WITH BUFFER MECHANISM FOR A SLIDING DOOR

BACKGROUND OF THE INVENTION

1. Field of the Invention

The present invention relates to a door closer, and more particularly to a door closer for a top hung sliding door that provides for efficient production and assembly.

2. Description of the Prior Arts

A sliding door opens by sliding, whereby a door panel is mounted on a track. Types of sliding doors include top hung sliding doors. The top hung sliding door has a door panel suspended from a track at a top edge and thereby the door panel can be easily moved. However, the door panel easily bumps against a doorframe if the door panel is slammed and that results in a big noise and causes the door panel or the doorframe to be damaged.

A door closer is mounted between the top edge of the door panel and the track to reduce the moving speed of the door panel and to keep the door panel and the doorframe from being damaged. A conventional door closer comprises a buffer mechanism and a trolley hanger. The buffer mechanism is secured to the track and includes a stationary base, a sliding block, a hook, two buffers and a resilient member. The sliding block is slidably mounted on the stationary base. The hook is pivotally mounted on the sliding block. The buffers are mounted on the stationary base and each buffer has a piston rod. The piston rod of one of said buffers abuts the sliding block and the piston rod of the other buffer abuts the trolley hanger. The resilient member is mounted on the stationary base and is secured to the sliding block at two ends. The trolley hanger is secured to the door panel, runs in the track and has an engaging recess selectively engaging the hook. When the door panel is opened, the trolley hanger drives the hook and the sliding block to slide relative to the stationary base and to pull the resilient member. When the door panel is closed, the buffers provide a buffering force and the resilient member releases a resilient force to reduce the moving speed of the door panel and to keep the door panel and the doorframe from being damaged.

However, the piston rods of the buffers must maintain an extended state to respectively abut the sliding block and the trolley hanger. Thus, a power device must be installed to drive the piston rods of the buffers to extend. This results in a high cost for the production of each door closer. Besides, because the piston rods of the buffers respectively abut the sliding block and the trolley hanger, travel distances of the piston rods are different. This then results in a difficult assembly process.

To overcome the shortcomings, the present invention provides a door closer for a top hung sliding door to mitigate or obviate the aforementioned problems.

SUMMARY OF THE INVENTION

The main object of the present invention is to provide a door closer for a top hung sliding door that provides for efficient production and assembly.

To achieve the foregoing objective, the door closer in accordance with the present invention comprises a buffer mechanism and a trolley hanger. The buffer mechanism includes a stationary base, a sliding block, a hook, two buffers and two resilient members. The sliding block is slidably mounted on the stationary base and has an inserting recess. The inserting recess has an open bottom. The hook is pivotally mounted on the sliding block. The buffers are mounted on the stationary base and each buffer has a cylinder barrel and a piston rod. The cylinder barrels are secured in the stationary base. The piston rods have free ends inserted into the inserting recess of the sliding block. An insert unit is inserted into the inserting recess of the sliding block through the open bottom of the inserting recess. The insert unit has a locking slot engaging the free ends of the piston rods to secure the piston rods to the sliding block. The resilient members are mounted on the stationary base and each resilient member has one end secured to the stationary base and the other end secured to the sliding block. The trolley hanger has at least one engaging recess selectively engaging the hook. Therefore, the buffers can provide a buffering force and the resilient member can release a resilient force to reduce a moving speed of a door panel. Additionally, because the piston rods of the buffers are driven by the sliding block, no power device needs to be installed to drive the piston rods of the buffers to extend and thus the present invention provides a cost effective improvement.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
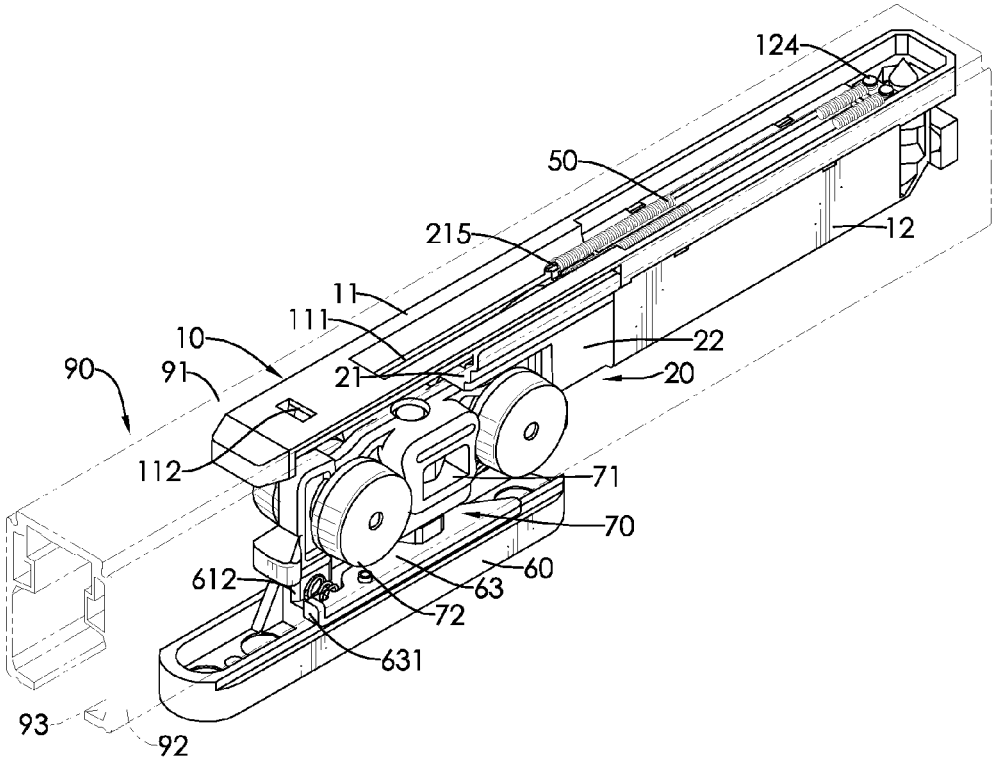
FIG. 1 is a perspective view of a door closer for a top hung sliding door in accordance with the present invention.
Figure 2:
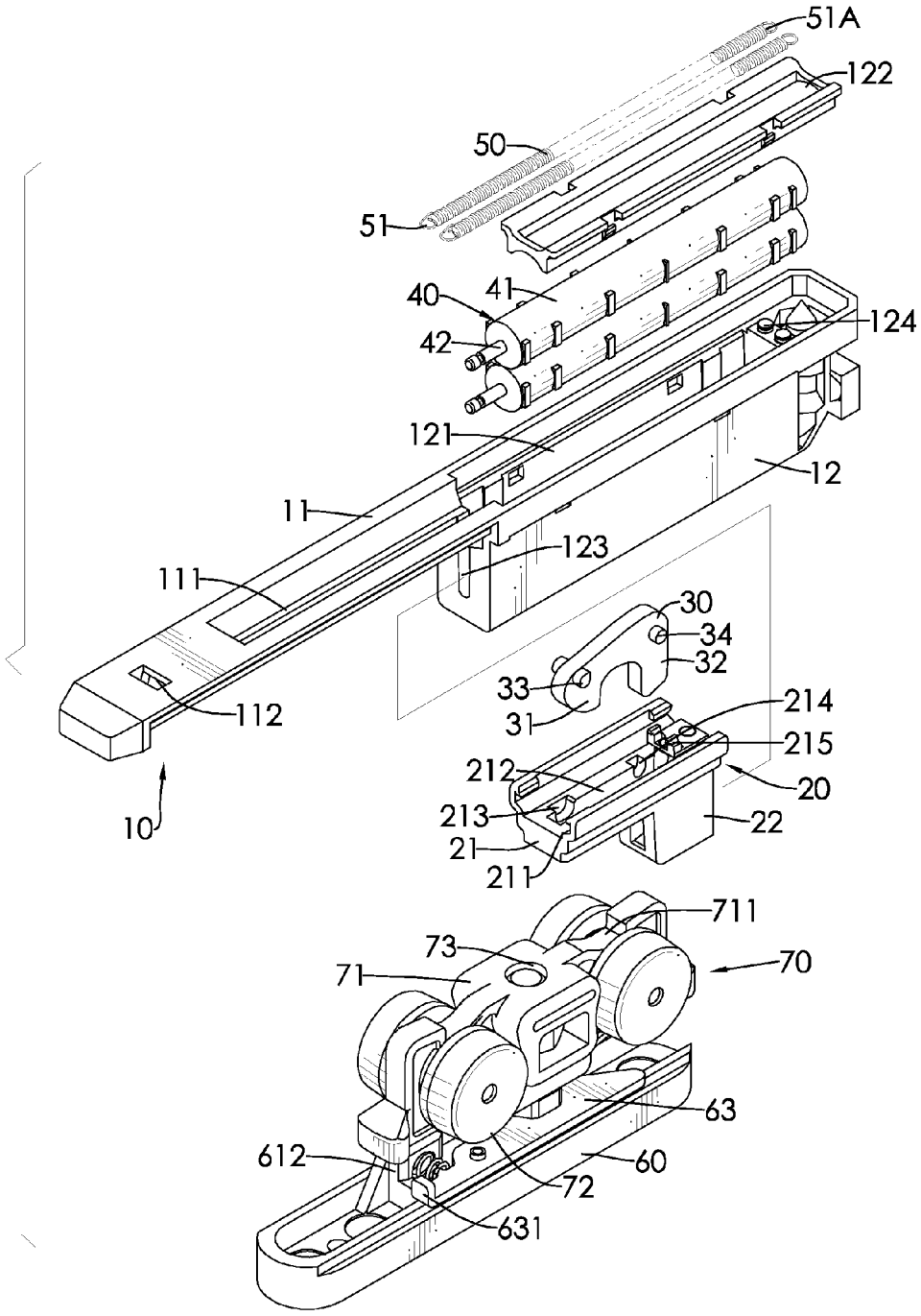
FIG. 2 is an exploded perspective view of the door closer in FIG. 1.
Figure 3:
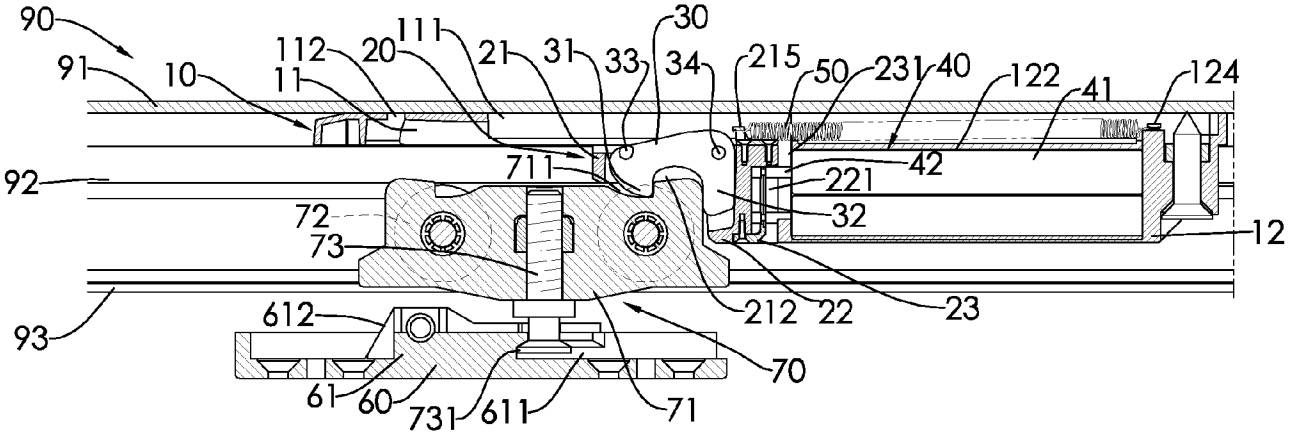
FIG. 3 is a side view in partial section of the door closer in FIG. 1.

With reference to FIGS. 1 to 3, a door closer for a top hung sliding door in accordance with the present invention comprises a buffer mechanism and a trolley hanger. The buffer mechanism includes a stationary base 10, a sliding block 20, a hook 30, two buffers 40 and two resilient members 50. The trolley hanger includes a sliding base 60 and a trolley 70.

The stationary base 10 is elongated and has a front portion and a rear portion. The front portion is a guide rail 11 and the rear portion is a mounting seat 12. The guide rail 11 is a board and has an elongated hole 111 and a locking hole 112. The elongated hole 111 is formed longitudinally through the guide rail 11. The locking hole 112 is formed through the guide rail 11 and is positioned in front of the elongated hole 111. The mounting seat 12 is a block and has a front surface, a top surface, a tank 121, a cover 122 and an aperture 123. The tank 121 is formed longitudinally in the top surface of the mounting seat 12, communicates with the elongated hole 111 of the guide rail 11 and has an open top. The cover 122 corresponds to and covers the open top of the tank 121. The aperture 123 is formed in the front surface of the mounting seat 12 and communicates with the tank 121.

Figure 4:
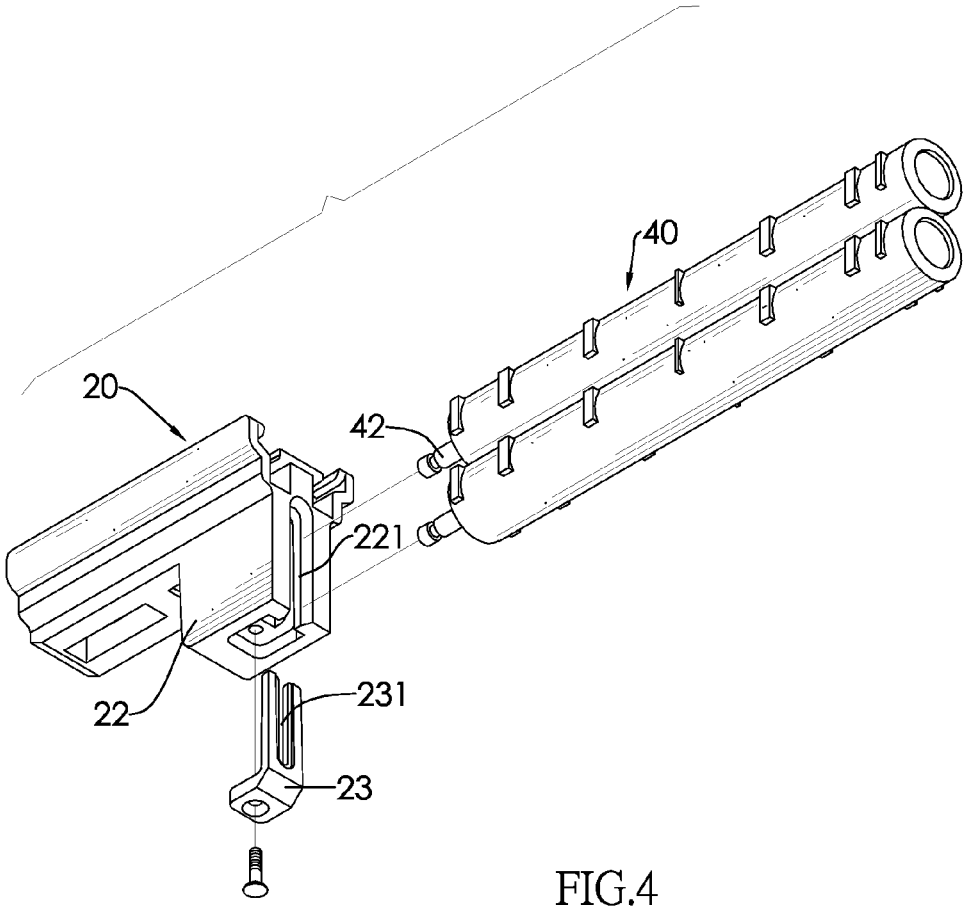
FIG. 4 is an exploded perspective view of a sliding block and two buffers of the door closer in FIG. 1.

The sliding block 20 is slidably mounted on the stationary base 10 along the guide rail 11 of the stationary base 10 and has a top board 21, a bottom block 22, a receiving hole 212, two front recesses 213 and two rear recesses 214. The top board 21 has a top surface, a bottom surface and a guide channel 211. The guide channel 211 is formed in the top surface of the top board 21 for receiving the guide rail 11 of the stationary base 10 and has two open ends and a channel surface. The bottom block 22 is formed on and protrudes from a rear portion of the bottom surface of the top board 21. The receiving hole 212 is formed through the channel surface of the guide channel 211, extends in a front surface of the bottom block 22 and has two opposite side hole surfaces. The front recesses 213 are respectively formed in front ends of the side hole surfaces of the receiving hole 212. The rear recesses 214 are respectively formed in rear ends of the side hole surfaces of the receiving hole 212. With reference to FIG. 4, the bottom block 22 has an inserting recess 221 formed in a rear surface of the bottom block 22 and having an open bottom.

With reference to FIGS. 1 to 3, the hook 30 is mounted in the receiving hole 212 of the sliding block 20, is pivotally mounted on the sliding block 20 and has a front end, a rear end, two side surfaces, a hooked portion 31, an extending board 32, two locking protrusions 33 and two pivoting protrusions 34. The hooked portion 31 is formed downward on the front end of the hook 30 and a bottom of the hooked portion 31 protrudes out of the receiving hole 212 of the sliding block 20. The extending board 32 is formed downward on the rear end of the hook 30. The locking protrusions 33 respectively protrude from the side surfaces of the hook 30 adjacent to the hooked portion 31, are received in the front recesses 213 of the sliding block 20 and are able to engage the locking hole 112 of the stationary base 10. The pivoting protrusions 34 respectively protrude from the side surfaces of the hook 30 adjacent to the extending board 32 and are pivotally received in the rear recesses 214 of the sliding block 20.

The buffers 40 may be hydraulic cylinders or pneumatic cylinders, are mounted on the mounting seat 12 of the stationary base 10, are arranged up and down and each buffer 40 has a cylinder barrel 41 and a piston rod 42. The cylinder barrel 41 is secured in the tank 121 of the mounting seat 12 of the stationary base 10 and the cover 122 of the stationary base 10 is positioned over the cylinder barrels 41. The piston rod 42 is retractably mounted and held in the cylinder barrel 41 and has a free end protruding out of the aperture 123 of the mounting seat 12 of the stationary base 10 and inserted into the inserting recess 221 of the sliding block 20. An insert unit 23 is securely inserted into the inserting recess 221 of the sliding block 20 from the open bottom of the inserting recess 221. The insert unit 23 has a locking slot 231 engaging the free ends of the piston rods 42 to secure the piston rods 42 to the sliding block 20.

The resilient members 50 may be tension springs, are mounted on the mounting seat 12 of the stationary base 10, are positioned over the cover 122 of the stationary base 10 and each resilient member 50 has two ends. One end of each resilient member 50 is secured to the stationary base 10 and the other end of each resilient member 50 is secured to the sliding block 20. In a preferred embodiment, the mounting seat 12 of the stationary base 10 further has two positioning columns 124 respectively protruding from the top surface of the mounting seat 12 and positioned in rear of the tank 121. The top board 21 of the sliding block 20 further has two clasping protrusions 215 respectively protruding from a rear end of the top surface of the top board 21. Each resilient member 50 further has two end hooks 51,51A formed on the ends thereof. One end hook 51 engages around a corresponding positioning column 124 of the stationary base 10 and the other end hook 51A engages around a corresponding clasping protrusion 215 of the sliding block 20.

Figure 5:
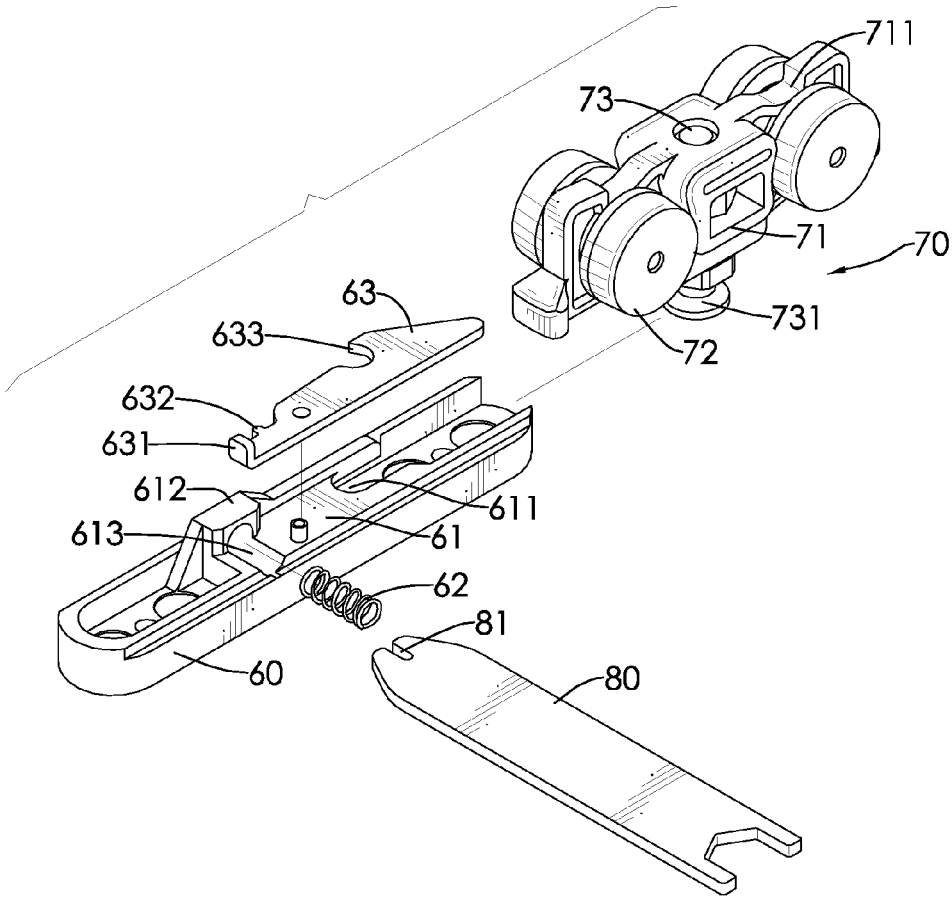
FIG. 5 is an exploded perspective view of a trolley hanger of the door closer in FIG. 1.

With further reference to FIG. 5, the sliding base 60 has a top surface and a positioning block 61. The positioning block 61 is formed on and protrudes from the top surface of the sliding base 60 and has a front end, a rear end, a top surface, a step recess 611, a protruding block 612 and a positioning recess 613. The step recess 611 is formed in the rear end of the positioning block 61 and has an expanding bottom. The protruding block 612 is formed on and protrudes from a side of the front end of the positioning block 61. The positioning recess 613 is formed in the top surface of the positioning block 61 adjacent to the protruding block 612 for receiving a spring 62. The spring 62 has two ends and one of the ends abuts the protruding block 612. Further, a clamping panel 63 is pivotally connected to the top surface of the positioning block 61 at a middle section and has a front end, a side, a pressing segment 631, a convex part 632 and a clamping recess 633. The pressing segment 631 protrudes upward from the front end of the clamping panel 63. The convex part 632 protrudes from the side of the clamping panel 63 and corresponds to and is mounted in the other end of the spring 62 so as to make the other end of the spring 62 abut the clamping panel 63. The clamping recess 633 is formed in the side of the clamping panel 63 and is positioned over the step recess 611 of the positioning block 61.

The trolley 70 is detachably mounted to the sliding base 60 and has a roller seat 71, multiple rollers 72 and a positioning rod 73. The roller seat 71 has a top surface, a bottom surface, two side surfaces and at least one engaging recess 711. The at least one engaging recess 711 is formed in the top surface of the roller seat 71 and selectively engages the hooked portion 31 of the hook 30. The rollers 72 are rotatably mounted on the side surfaces of the roller seat 71. The positioning rod 73 is securely mounted through a middle portion of the roller seat 71 and has a bottom end. The bottom end of the positioning rod 73 protrudes from the bottom surface of the roller seat 71, is mounted in the step recess 611 of the sliding base 60 and has an expanding section 731. The expanding section 731 is received in the expanding bottom of the step recess 611 and the clamping recess 633 of the clamping panel 63 clamps around the positioning rod 73 so as to connect the trolley 70 to the sliding base 60. In a preferred embodiment, the roller seat 71 has two engaging recesses 711 respectively formed in a front end and a rear end of the top surface of the roller seat 71. The trolley 70 has four rollers 72 respectively rotatably mounted on a front end and a rear end of the two side surfaces of the roller seat 71.

When the trolley 70 is assembled with the sliding base 60, a tool panel 80 may be used in the assembly process. The tool panel 80 has two ends and a recess 81 formed in one end thereof. A user can hold the other end of the tool panel 80 and make the recess 81 of the tool panel 80 engage the pressing segment 631 of the clamping panel 63 and move the tool panel 80 toward the spring 62. The clamping panel 63 is pivoted to compress the spring 62 and to make the clamping recess 633 of the clamping panel 63 move away from the step recess 611 of the positioning block 61. Under this circumstance, the positioning rod 73 of the trolley 70 can be mounted in the step recess 611 of the sliding base 60 and the tool panel 80 is then removed from the pressing segment 631 of the clamping panel 63. The spring 62 provides resilient force to the front end of the clamping panel 63 so that the clamping panel 63 is pivoted in reverse and the clamping recess 633 of the clamping panel 63 clamps around the positioning rod 73 of the trolley 70. Thus, the trolley 70 and the sliding base 60 are assembled.

Figure 6:
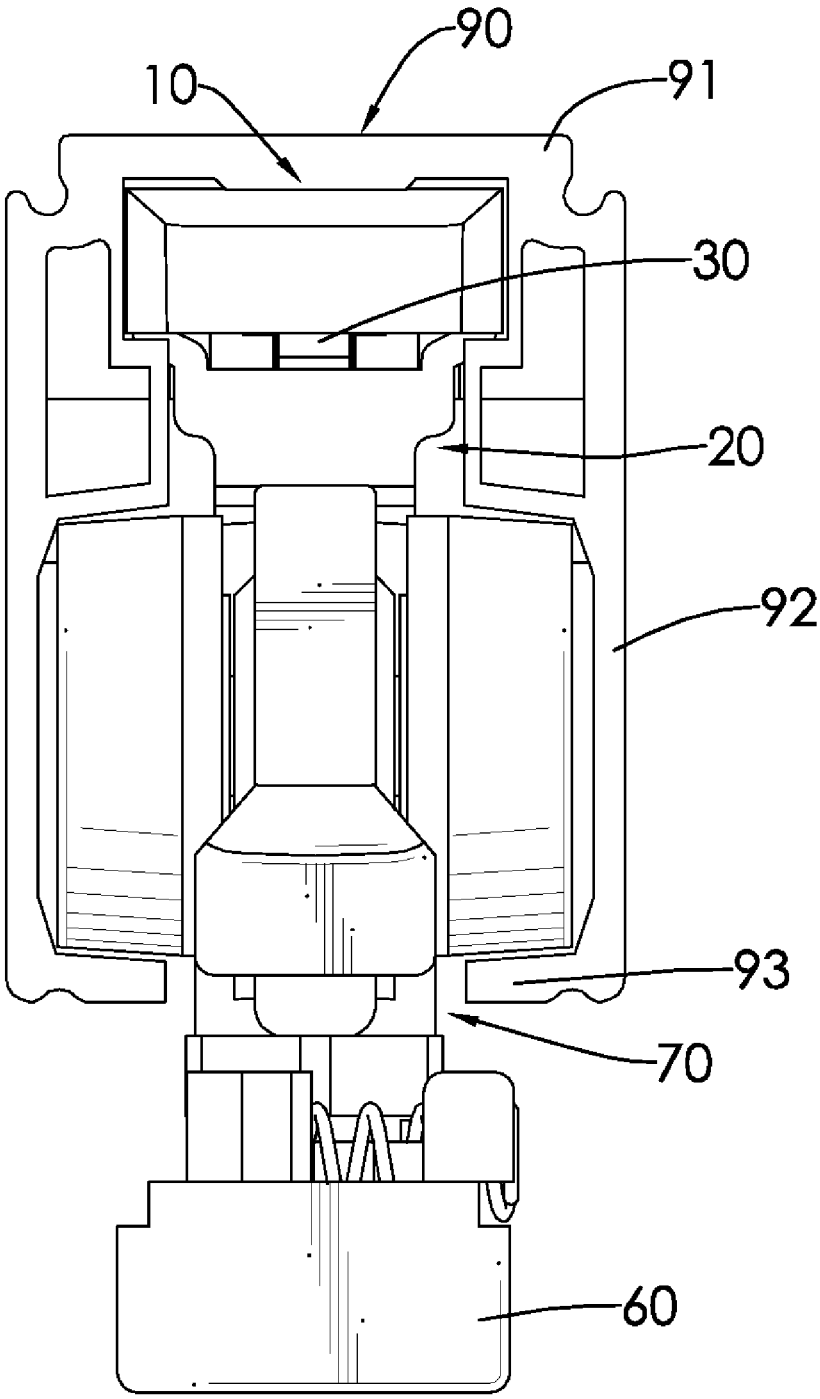
FIG. 6 is a front view of the door closer in FIG. 1.

With reference to FIGS. 1, 3 and 6, when the door closer in accordance with the present invention is in use, the buffer mechanism is mounted in a track 90 and the trolley hanger is mounted on a door panel (not shown). The track 90 is made of extruded aluminum and has a top wall 91, two opposite sidewalls 92 and two bottom walls 93. A top surface of the stationary base 10 is secured to the top wall 91 of the track 90. A bottom surface of the sliding base 60 is secured to the door panel and the trolley 70 runs in the track 90 and is positioned over the bottom walls 93 of the track 90. Then, the trolley 70 is assembled with the sliding base 60 by performing the foregoing assembly procedures.

Figure 7:
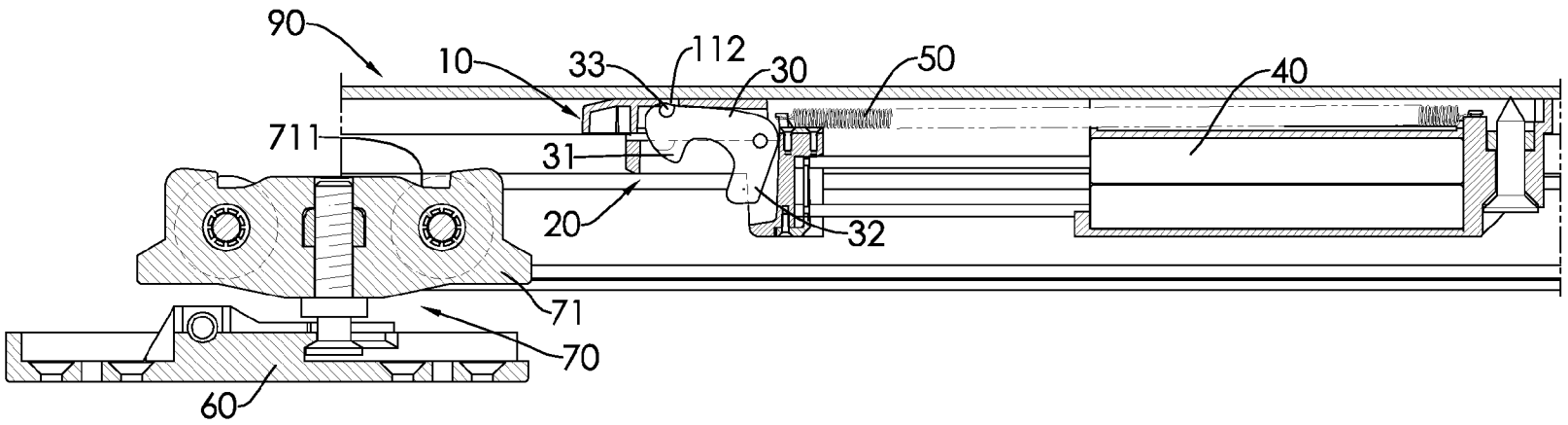

With reference to FIG. 3, when the door panel is in a closed state, the hooked portion 31 of the hook 30 engages the engaging recess 711 of the trolley 70. To open the door panel, the door panel is moved to the left as shown in FIG. 3 and drives the trolley hanger to slide along the track 90. The hook 30 and the sliding block 20 are then driven to slide along the guide rail 11 of the stationary base 10 to extend the piston rods 42 of the buffers 40 and to stretch the resilient members 50. As the hook 30 and the sliding block 20 are sliding, the locking protrusions 33 of the hook 30 abut a bottom surface of the guide rail 11 of the stationary base 10. The hook 30 and the sliding block 20 can slide relative to the stationary base 10 until the locking protrusions 33 of the hook 30 correspond to the locking hole 112 of the stationary base 10. With reference to FIG. 7, the hook 30 is pivoted relative to the sliding block 20 to make the locking protrusions 33 of the hook 30 engage the locking hole 112 of the stationary base 10 and the hooked portion 31 of the hook 30 disengage from the engaging recess 711 of the trolley 70. Under this circumstance, the buffers 40 and the resilient members 50 store energy and the door panel can keep moving.

Figure 8:
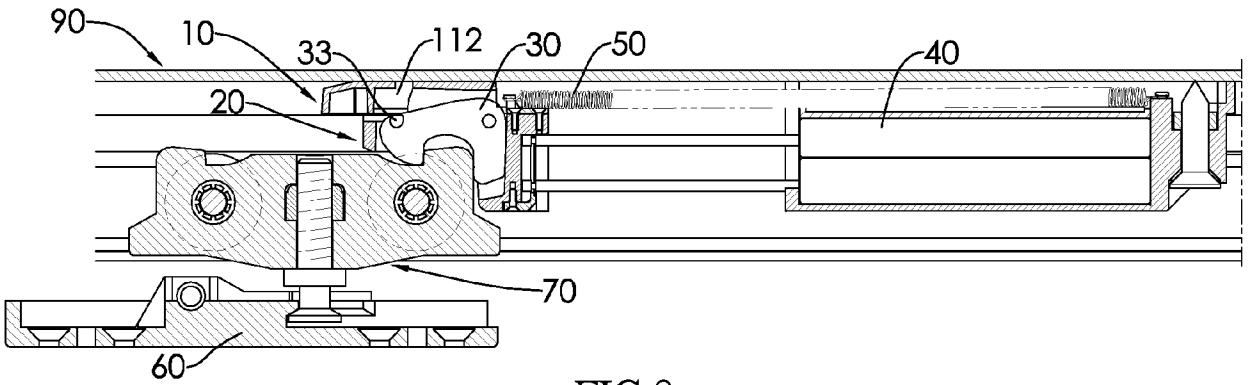
FIGS. 7 to 9 are operational side views in partial section of the door closer in FIG. 1.

To close the door panel, the door panel is moved to the right as shown in FIG. 8 and drives the trolley hanger to slide along the track 90 and makes the engaging recess 711 of the trolley 70 move close to the hooked portion 31 of the hook 30. When the roller seat 71 of the trolley 70 pushes the extending board 32 of the hook 30, the hook 30 is pivoted relative to the sliding block 20 to make the hooked portion 31 of the hook 30 engage the engaging recess 711 of the trolley 70 and the locking protrusions 33 of the hook 30 disengage from the locking hole 112 of the stationary base 10. Under this circumstance, the buffers 40 provide a damping force and the resilient members 50 release a resilient force to reduce the moving speed of the door panel and to prevent the door panel and the doorframe from being damaged and from causing noise. Besides, because the two piston rods 42 of the buffers 40 are driven by the sliding block 20, no power device needs to be installed to drive the piston rods 42 of the buffers 40 to extend and thus the present invention provides a cost effective improvement. Moreover, the two piston rods 42 of the buffers 40 are moved synchronously and travel distances of the piston rods 42 are the same so that assembly process can be simplified.

Figure 9:
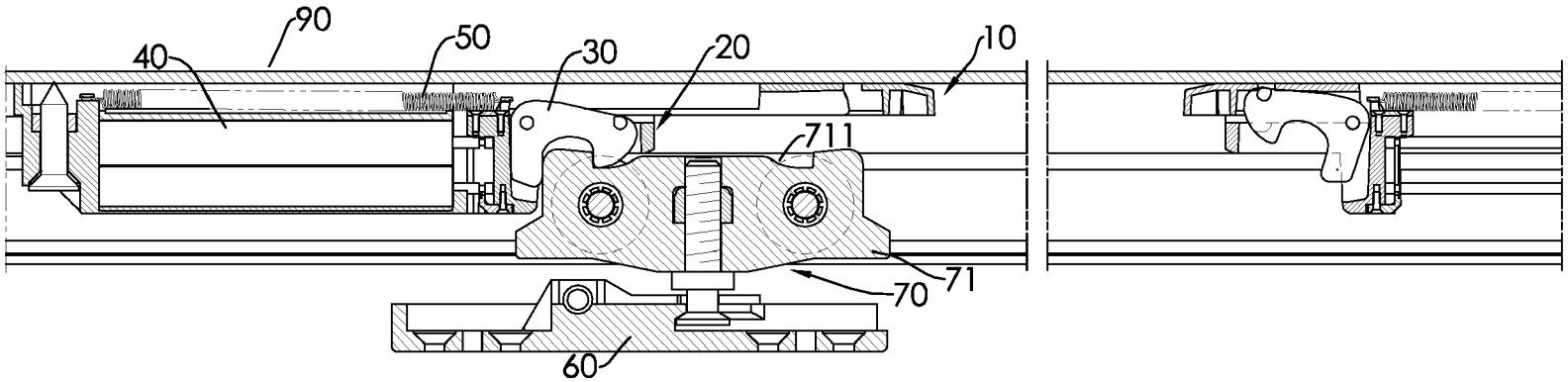

With reference to FIG. 9, because roller seat 71 of the trolley 70 has two engaging recesses 711 respectively formed in two ends of the roller seat 71, one trolley hanger with two symmetrical buffer mechanisms may be used cooperatively. The two symmetrical buffer mechanisms are respectively mounted on two ends of the track 90. Therefore, no matter whether the door panel is moved to the right end or the left end, the closing speed of the door panel can be reduced.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A door closer for a top hung sliding door comprising:

a buffer mechanism, adapted to be mounted in a sliding track, including
- a stationary base having
  - a front portion being a guide rail having a locking hole; and
  - a rear portion being a mounting seat;
- a sliding block slidably mounted on the stationary base and having
  - a guide channel for receiving the guide rail of the stationary base; and
  - an inserting recess having an open bottom;
- a hook pivotally mounted on the sliding block and having
  - two side surfaces;
  - a hooked portion; and
  - two locking protrusions respectively protruding from the side surfaces of the hook adjacent to the hooked portion and being able to engage the locking hole of the stationary base;
- two buffers mounted on the mounting seat of the stationary base and each buffer having
  - a cylinder barrel secured in the mounting seat of the stationary base; and
  - a piston rod retractably mounted and held in the cylinder barrel and having a free end inserted into the inserting recess of the sliding block, an insert unit securely inserted into the inserting recess of the sliding block from the open bottom of the inserting recess and having a locking slot engaging the free ends of the piston rods to secure the piston rods to the sliding block; and
- two resilient members mounted on the mounting seat of the stationary base and each resilient member having two ends, one end of each resilient member secured to the stationary base and the other end of each resilient member secured to the sliding block; and a trolley hanger, adapted to be mounted on a door panel, including
- a sliding base; and
- a trolley detachably mounted to the sliding base and having
  - a roller seat having
    - a top surface;
    - two side surfaces; and
    - at least one engaging recess formed in the top surface of the roller seat and selectively engaging the hooked portion of the hook; and
  - multiple rollers, adapted to run in the track, rotatably mounted on the side surfaces of the roller seat.

2. The door closer as claimed in claim 1, wherein the sliding block has
- a receiving hole formed through a channel surface of the guide channel and having two opposite side hole surfaces; and
- two rear recesses respectively formed in rear ends of the side hole surfaces of the receiving hole; and the hook is mounted in the receiving hole of the sliding block and has
- an extending board; and two pivoting protrusions respectively protruding from the side surfaces of the hook adjacent to the extending board and pivotally received in the rear recesses of the sliding block.

3. The door closer as claimed in claim 2, wherein the roller seat of the trolley has two engaging recesses respectively formed in a front end and a rear end of the top surface of the roller seat.

4. The door closer as claimed in claim 3, wherein
the sliding base has
a top surface; and
a positioning block formed on and protruding from the top surface of the sliding base and having
a front end;
a rear end;
a top surface;
a step recess formed in the rear end of the positioning block and having an expanding bottom; and
a protruding block formed on and protruding from a side of the front end of the positioning block;
a spring mounted adjacent to the protruding block and having two ends, one of the ends of the spring abutting the protruding block;
a clamping panel pivotally connected to the top surface of the positioning block and having
a side against which the other end of the spring abuts; and
a clamping recess formed in the side of the clamping panel and positioned over the step recess of the positioning block; and
the trolley further has
a positioning rod securely mounted through the roller seat and having
a bottom end protruding from a bottom surface of the roller seat, mounted in the step recess of the sliding base and having an expanding section received in the expanding bottom of the step recess and the clamping recess of the clamping panel clamping around the positioning rod.

5. The door closer as claimed in claim 4, wherein the clamping panel further has a pressing segment protruding upward from a front end thereof and a tool panel has a recess formed therein and engaging the pressing segment of the clamping panel.

6. The door closer as claimed in claim 2, wherein the sliding block further has two front recesses respectively formed in front ends of the side hole surfaces of the receiving hole and the locking protrusions of the hook are received in the front recesses of the sliding block.

7. The door closer as claimed in claim 6, wherein the roller seat of the trolley has two engaging recesses respectively formed in a front end and a rear end of the top surface of the roller seat.

8. The door closer as claimed in claim 7, wherein
the sliding base has
a top surface; and
a positioning block formed on and protruding from the top surface of the sliding base and having
a front end;
a rear end;
a top surface;
a step recess formed in the rear end of the positioning block and having an expanding bottom; and
a protruding block formed on and protruding from a side of the front end of the positioning block;
a spring mounted adjacent to the protruding block and having two ends, one of the ends of the spring abutting the protruding block;
a clamping panel pivotally connected to the top surface of the positioning block and having
a side against which the other end of the spring abuts; and
a clamping recess formed in the side of the clamping panel and positioned over the step recess of the positioning block; and
the trolley further has
a positioning rod securely mounted through the roller seat and having
a bottom end protruding from a bottom surface of the roller seat, mounted in the step recess of the sliding base and having an expanding section received in the expanding bottom of the step recess and the clamping recess of the clamping panel clamping around the positioning rod.

9. The door closer as claimed in claim 8, wherein the clamping panel further has a pressing segment protruding upward from a front end thereof and a tool panel has a recess formed therein and engaging the pressing segment of the clamping panel.

10. The door closer as claimed in claim 6, wherein
the mounting seat of the stationary base has
a top surface;
a tank formed in the top surface of the mounting seat and having an open top; and
a cover corresponding to and covering the open top of the tank;
the cylinder barrels of the buffers are secured in the tank of the mounting seat of the stationary base and the cover of the stationary base is positioned over the cylinder bodies; and
the resilient members are positioned over the cover of the stationary base.

11. The door closer as claimed in claim 10, wherein the roller seat of the trolley has two engaging recesses respectively formed in a front end and a rear end of the top surface of the roller seat.

12. The door closer as claimed in claim 11, wherein
the sliding base has
a top surface; and
a positioning block formed on and protruding from the top surface of the sliding base and having
a front end;
a rear end;
a top surface;
a step recess formed in the rear end of the positioning block and having an expanding bottom; and
a protruding block formed on and protruding from a side of the front end of the positioning block;
a spring mounted adjacent to the protruding block and having two ends, one of the ends of the spring abutting the protruding block;
a clamping panel pivotally connected to the top surface of the positioning block and having
a side against which the other end of the spring abuts; and
a clamping recess formed in the side of the clamping panel and positioned over the step recess of the positioning block; and
the trolley further has
a positioning rod securely mounted through the roller seat and having a bottom end protruding from a bottom surface of the roller seat, mounted in the step recess of the sliding base and having an expanding section received in the expanding bottom of the step recess and the clamping recess of the clamping panel clamping around the positioning rod.

13. The door closer as claimed in claim 12, wherein the clamping panel further has a pressing segment protruding upward from a front end thereof and a tool panel has a recess formed therein and engaging the pressing segment of the clamping panel.

14. The door closer as claimed in claim 10, wherein the mounting seat of the stationary base further has two positioning columns respectively protruding from the top surface of the mounting seat and positioned in rear of the tank;

the sliding block further has two clasping protrusions respectively protruding from a rear end of the sliding block; and each resilient member further has two end hooks formed on the ends thereof, one end hook engages around a corresponding positioning column of the stationary base and the other end hook engages around a corresponding clasping protrusion of the sliding block.

15. The door closer as claimed in claim 14, wherein the roller seat of the trolley has two engaging recesses respectively formed in a front end and a rear end of the top surface of the roller seat.

16. The door closer as claimed in claim 15, wherein the sliding base has a top surface; and a positioning block formed on and protruding from the top surface of the sliding base and having a front end;

a rear end;

a top surface;

a step recess formed in the rear end of the positioning block and having an expanding bottom; and a protruding block formed on and protruding from a side of the front end of the positioning block;

a spring mounted adjacent to the protruding block and having two ends, one of the ends of the spring abutting the protruding block;

a clamping panel pivotally connected to the top surface of the positioning block and having a side against which the other end of the spring abuts; and a clamping recess formed in the side of the clamping panel and positioned over the step recess of the positioning block; and the trolley further has a positioning rod securely mounted through the roller seat and having a bottom end protruding from a bottom surface of the roller seat, mounted in the step recess of the sliding base and having an expanding section received in the expanding bottom of the step recess and the clamping recess of the clamping panel clamping around the positioning rod.

17. The door closer as claimed in claim 16, wherein the clamping panel further has a pressing segment protruding upward from a front end thereof and a tool panel has a recess formed therein and engaging the pressing segment of the clamping panel.

18. The door closer as claimed in claim 1, wherein the roller seat of the trolley has two engaging recesses respectively formed in a front end and a rear end of the top surface of the roller seat.

19. The door closer as claimed in claim 18, wherein the sliding base has a top surface; and a positioning block formed on and protruding from the top surface of the sliding base and having a front end;

a rear end;

a top surface;

a step recess formed in the rear end of the positioning block and having an expanding bottom; and a protruding block formed on and protruding from a side of the front end of the positioning block;

a spring mounted adjacent to the protruding block and having two ends, one of the ends of the spring abutting the protruding block;

a clamping panel pivotally connected to the top surface of the positioning block and having a side against which the other end of the spring abuts; and a clamping recess formed in the side of the clamping panel and positioned over the step recess of the positioning block; and the trolley further has a positioning rod securely mounted through the roller seat and having a bottom end protruding from a bottom surface of the roller seat, mounted in the step recess of the sliding base and having an expanding section received in the expanding bottom of the step recess and the clamping recess of the clamping panel clamping around the positioning rod.

20. The door closer as claimed in claim 19, wherein the clamping panel further has a pressing segment protruding upward from a front end thereof and a tool panel has a recess formed therein and engaging the pressing segment of the clamping panel.

* * * * *